US005393355A

United States Patent [19]

Nakano et al.

[11] Patent Number: 5,393,355

[45] Date of Patent: Feb. 28, 1995

[54] LOW-IRON LOSS GRAIN ORIENTED ELECTROMAGNETIC STEEL SHEET AND METHOD OF PRODUCING THE SAME

[75] Inventors: Koh Nakano; Keiji Sato; Bunjiro Fukuda, all of Chiba, Japan

[73] Assignee: Kawasaki Steel Corporation, Japan

[21] Appl. No.: 964,367

[22] Filed: Oct. 21, 1992

[30] Foreign Application Priority Data

Oct. 24, 1991 [JP] Japan ..... 3-277802

[51] Int. Cl.[6] ..... H01F 1/04

[52] U.S. Cl. ..... 148/306; 148/308; 420/117

[58] Field of Search ..... 148/306, 307, 308, 111; 420/117

[56] References Cited

U.S. PATENT DOCUMENTS 3,947,296 3/1976 Kumazawa ..... 148/111
4,904,312 2/1990 Beckley et al. ..... 148/110

FOREIGN PATENT DOCUMENTS 3-267319 11/1991 Japan ..... 148/111
4-88121 3/1992 Japan ..... 148/111

*Primary Examiner*—John P. Sheehan
*Attorney, Agent, or Firm*—Austin R. Miller

[57] ABSTRACT

A low-iron loss grain oriented electromagnetic steel sheet subjected to final finishing annealing has a plurality of linear grooves formed on surface of the steel sheet in a direction across the rolling direction, so as to improve the magnetic characteristics of the steel sheet. The linear grooves have a substantially rectangular cross-sectional shape in which the angle of a groove side wall to the direction of the thickness of the sheet is about 60° or less. Projections are present at a bottom portion of the groove, and the depth at the top of the projection at the groove bottom is at least about ½ of the maximum groove depth. The steel sheet maintains a low iron loss even after stress relief annealing. The present invention provides a method of stably producing the steel sheet.

1 Claim, 3 Drawing Sheets

LOW-IRON LOSS GRAIN ORIENTED ELECTROMAGNETIC STEEL SHEET AND METHOD OF PRODUCING THE SAME

BACKGROUND OF THE INVENTION

Field of the Invention

The present invention relates to a new low-iron loss grain oriented electromagnetic steel sheet and to a method of producing the same. This invention particularly relates to an electromagnetic steel sheet which maintains a low iron loss after stress relief annealing. This invention further relates to an electromagnetic steel sheet having advantage as a core material of a, transformer or other electrical apparatus.

Description of the Related Art

A grain oriented electromagnetic steel sheet is used as an iron core of a transformer or other electrical apparatus and is thus required to exhibit a low iron loss.

The term "iron loss" is generally represented by the sum of the hysteresis loss and the eddy current loss. The hysteresis loss is generally significantly decreased by highly integrating the crystal orientation in the Goss orientation, i.e., the (110)<001> orientation, using an inhibitor having strong inhibitory force or by decreasing the amounts of elements present as impurities which cause the generation of a pinning factor for movement of magnetic domain walls during magnetization. On the other hand, the eddy current loss is generally decreased by increasing the Si content of the steel sheet in order to increase its electrical resistance, by decreasing the thickness of a steel sheet, or by forming a film with a thermal expansion coefficient different from that of ferrite on the ferrite surface of the steel sheet in order to apply tension thereto, or by decreasing the sizes of crystal grains in order to decrease the width of the magnetic domain, for example.

In recent years a method has been proposed for further decreasing the eddy current loss of the steel in which a laser beam (Japanese Patent Publication No. 57-2252) or a plasma flame (Japanese Patent Laid-Open No. 62-96617) is applied to a steel sheet in a direction vertical to the rolling direction thereof. This method is designed for finely dividing the magnetic domains by introducing a small thermal train in the form of a line or points into the surface of the steel sheet, thereby significantly decreasing its iron loss.

About half of the transformer cores using grain oriented silicon steel sheet are small iron cores known as wound cores. In such wound cores a strain is produced by mechanical external force during the deformation process in the course of production, resulting in deterioration of magnetic characteristics. It is inevitable that the wound cores are thus generally subjected to stress relief annealing at about 800° C. in order to remove the strain produced by processing.

However, in the above method, the effect of decreasing the iron loss is lost by heat treatment at about 800° C. after the magnetic domain has been finely divided. The method cannot be thus used for wound core materials which are required to be annealed for removing stain at about 800° C. or more after irradiation.

Various methods of forming grooves in a steel sheet have been thus proposed for finely dividing the magnetic domains so that they will not be affected by stress relief annealing at 800° C. or more. An example is one in which grooves are locally formed on a steel sheet after final finish annealing, i.e., secondary recrystallization, so that the magnetic domain is finely divided by the diamagnetic field effect of the grooves. In this case, methods of forming the grooves include the method disclosed in Japanese Patent Publication No. 50-35679 which employs mechanical processing or the method disclosed in Japanese Patent Laid-Open No. 63-76819 in which an insulating film and a ground coated film are locally removed by applying a laser beam thereto, followed by electrolytic etching, and the like. Japanese Patent Publication No. 62-53579 discloses a method in which grooves are formed by stress relief annealing after engraving under pressure by a gear-type roll, and the magnetic domain is finely divided by recrystallization annealing. Further, Japanese Patent Laid-Open No. 59-197520 discloses a method for forming grooves on a steel sheet before final finishing annealing.

The above methods encounter the problem that although the iron loss is sometimes reduced even after stress relief annealing at 800° C. or more, the methods cannot always achieve a reduction in iron loss. Namely, deviation occurs in the effect of reducing the iron loss even if the groove width and depth are the same.

SUMMARY OF THE INVENTION

It is an object of the present invention to advantageously solve the above problems and provide a grain oriented electromagnetic steel sheet which stably maintains a low iron loss without deterioration even after stress relief annealing. Another object of the invention is to provide a method of stably producing such a steel sheet.

As a result of energetic experiment and investigation performed by the inventors and research into the cause for the deviation of reduction of the iron loss, it has been discovered that the sectional form of the grooves is closely related to the iron loss reduction effect. More particularly, we have discovered that with the same groove width and maximum groove depth, achievement of decreased iron loss is significantly affected by the following conditions:

(1) the angle of the groove side wall with respect to the thickness direction of the steel sheet; and (2) irregularities or protrusions at the bottom portion of the groove.

The present invention has been achieved on the basis of the above finding.

DESCRIPTION OF THE PREFERRED EMBODIMENTS

The results of work leading to the achievement of the present invention are described in the following illustrative example.

After an etching resist agent was coated on a steel sheet having a thickness of 0.23 mm and after final cold rolling, linear grooves each having a width of 200 μm and a depth of 15 μm were formed on the sheet at intervals of 3 mm in the direction substantially across the rolling direction. This was done by electrolytic etching or acid washing. The resist agent was then removed and the steel sheet was subjected to the usual steps of decarburizing annealing and finishing annealing.

Samples were obtained from the thus-formed steel sheet and were then measured with respect to sheet magnetic characteristics after stress relief annealing at 800° C. for 3 hours.

At the same time, a sample was obtained from a portion of the same material where no groove was formed, and this was used as a comparative sample.

Although the iron loss $W_{17/50}$ of all the samples with the grooves was improved, as compared with the comparative sample, the degrees of improvement $\Delta W_{17/50}$ were found to vary widely within the range of 0.02 to 0.12 W/kg.

We examined the obtained samples in detail. As a result we have discovered that the effect of improving iron loss depends upon the shapes of the grooves, even if their widths and depths are the same.

Figure 1:
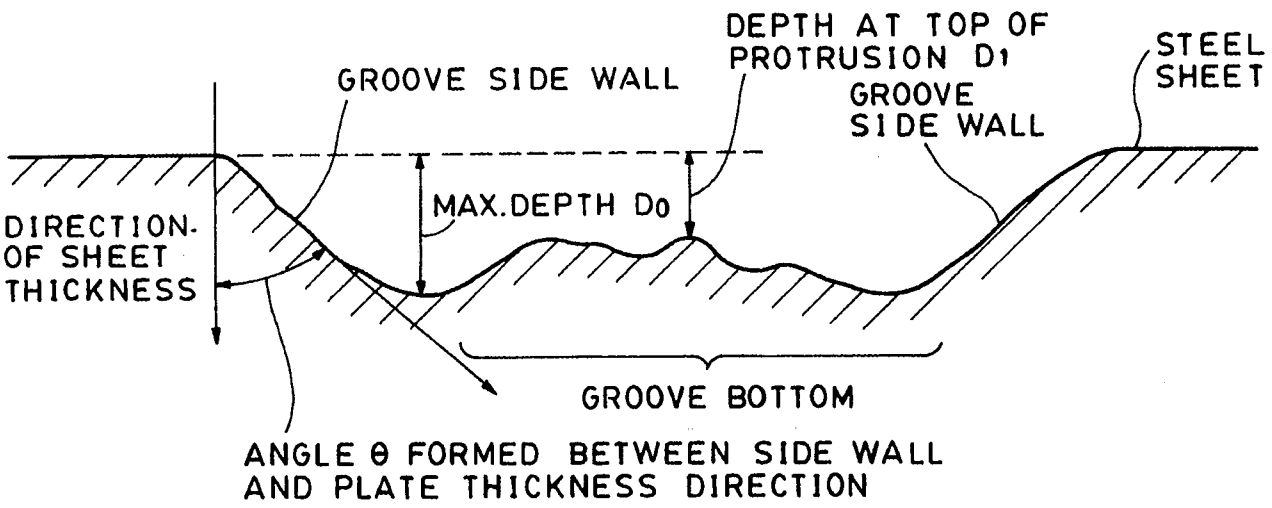
FIG. 1 is an enlarged sectional view schematically showing the cross-section of a linear groove.

FIG. 1 is an enlarged sectional view schematically showing the cross-section of a linear groove obtained by etching.

In the etched groove, ferrite is exposed along each groove wall which has a slope from the edge of the groove to the bottom of the groove. A ferrite protrusion remains undissolved at the bottom of the groove, particularly in the vicinity of the center of the bottom portion. We have found that the effect of improving the iron loss of the sheet is significantly affected by the angle $\theta$ of the side wall of the groove with respect to the thickness direction of the sheet. It is further significantly affected by the ratio between the depth $D_1$ at the ferrite protrusion of the groove (minimum depth) and the maximum depth $D_0$ of the groove itself.

Figure 2:
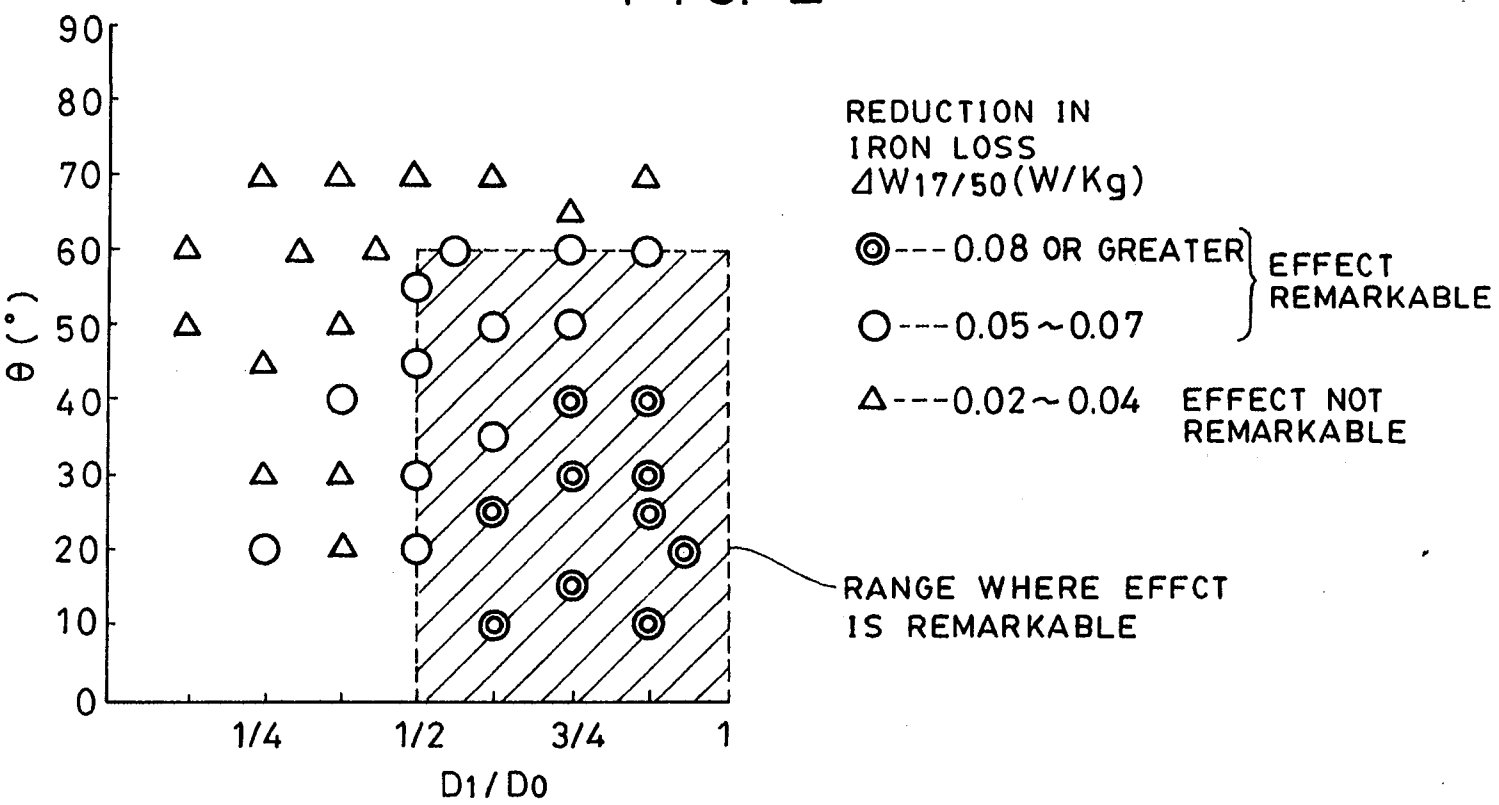
FIG. 2 is a graph showing the influences of the ratio $D_1/D_0$ of the minimum depth $D_1$ of the protrusion of a groove to the maximum depth $D_0$ of the groove and the angle $\theta$ of the groove side wall or walls with respect to the thickness direction of the steel sheet.

FIG. 2 is a graph showing the results of examination of a preferred range where the iron loss reduction effect is remarkable. In FIG. 2, the ratio $D_1/D_0$ is the abscissa and the angle $\theta$ of the groove side wall with respect to the thickness direction of the sheet is the ordinate.

As will be seen from FIG. 2, when $D_1/D_0$ is about $\frac{1}{2}$ or more, and the angle 8 is about 60° or less, the value of $\Delta W_{17/50}$ is greater than 0.05 W/kg and excellent reduction of iron loss is obtained.

In the present invention, therefore, the ratio $D_1/D_0$ of the depth $D_1$ at the protrusion of a groove to the maximum depth $D_0$ of the groove is limited to about $\frac{1}{2}$ or more, and the angle $\theta$ of the groove side wall with respect to the thickness direction of the sheet is limited to about 60° or less.

Although the reason for the importance of the above values is not yet clearly elucidated, it is supposed that this is because a groove having a substantially rectangular sectional form has a remarkable diamagnetic field effect.

When the groove side wall has irregularity, the angle $\theta$ of the groove side wall to the thickness direction may be determined by measuring the angle of the center line of the irregularity, which can be determined by approximation.

In this case, the maximum depth of the groove must be about 100 μm or less because the effect of decreasing iron loss deteriorates beyond that range. The width of the groove is preferably about 300 μm or less because if the width exceeds about 300 μm iron loss reduction deteriorates.

In addition, it is necessary that the direction of the grooves crosses the rolling direction (<001> orientation). If the direction of the grooves is the same as the rolling direction, this adversely affects the iron loss reduction. Further the intervals between grooves, observed in the rolling direction, are preferably about 1 mm or more. The grooves may be formed either on one side or both sides of the steel sheet.

We turn now to preferred etching methods for forming grooves having preferred shapes.

In the case of electrolytic etching, grooves having a maximum depth of about 100 μm or less and a width of about 300 μm or less can be formed by appropriately selecting conditions such as the type of electrolyte used, the current density and the treatment time. In the case of chemical etching, such grooves can be formed by appropriately selecting the conditions such as the liquid composition, the liquid concentration, the liquid temperature and the treatment time. However, mere changing of these parameters does not resolve the problem and does not alone produce a grain oriented electromagnetic steel sheet which stably maintains a low iron loss without deterioration even after stress relief annealing.

Linear grooves of this invention have a substantially rectangular cross-sectional shape, which need not be exactly rectangular but have side walls in which the angle $\theta$ between the groove side wall and the thickness direction of the sheet is about 60° or less. Further, these linear grooves tend to have protrusions extending upwardly at the bottom portion of the groove, and the depth at the protrusion is at least about $\frac{1}{2}$ of the maximum depth of a groove. This remarkable structure cannot be stably obtained by simply changing the chemical etching compositions alone.

We have energetically investigated many conditions of electrolytic etching and chemical etching over a wide range. As a result we have found that in order to obtain stable linear grooves each having a substantially rectangular cross-sectional shape, or a shape in which the angle $\theta$ which extends between the groove side wall and the thickness direction is about 60° or less, and wherein the depth at the protrusion is at least about $\frac{1}{2}$ of the maximum depth of a groove, this can be achieved by controlling the flow velocity of the etchant used in either electrolytic etching or chemical etching. This finding is important in the method of the present invention and greatly improves the product.

Figure 3:
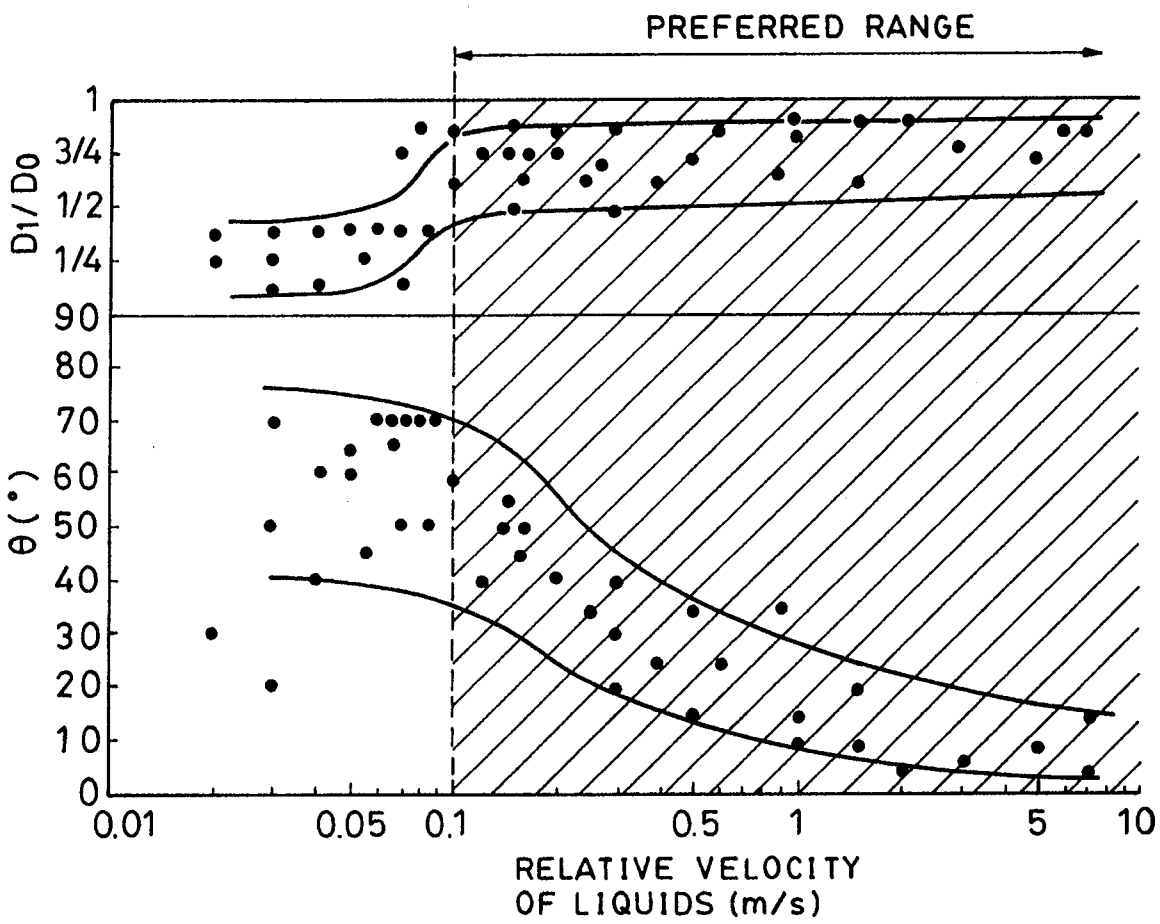
FIG. 3 is a graph showing the influences of the flow velocity of an etchant on the ratio $D_1/D_0$ of the minimum depth $D_1$ at the top of a groove protrusion to the groove maximum depth $D_0$ and the angle $\theta$ of the groove side wall with respect to the thickness direction of the steel sheet.

FIG. 3 shows the results of examination of effects of flow velocity of an etchant on the ratio $D_1/D_0$ of the depth $D_1$ at the protrusion of a groove to the maximum depth $D_0$ of the groove and the angle of the groove side wall to the thickness direction of the steel sheet.

The steel sheet used in the examination shown in FIG. 3 had grooves which were formed by etching after the film on the surface had been locally removed by scratching with a knife edge after finishing annealing, so as to have a width of 200 μm and a depth of 15 μm.

Electrolytic etching was effected in an aqueous NaCl solution at a temperature of 40° C. with a current density of 10 A/dm$^2$ and a electrode distance of 30 mm. Chemical etching was effected in an $FeCl_3$ solution at 35° C.

FIG. 3 reveals that when the flow velocity of the etchant is at least about 0.1 m/s, the angle $\theta$ will be equal to or less than about 60° and $D_1/D_0$ will be equal to or greater than about $\frac{1}{2}$.

The cause for the influence upon groove shape of a change of flow velocity of the etchant is supposed to be the following:

In the case of electrolytic etching, assuming a flow rate of 0, the iron eluted as a result of the etching reaction remains in the grooves as the etching proceeds and gradually inhibits electron transfer between the anode and the cathode. Accordingly, the groove side wall and the groove bottom remain partially undissolved.

We have found that the amount of iron eluted and remaining in the grooves may be gradually decreased by gradually increasing the flow rate of the etchant, and that this can create grooves having a preferred shape in accordance with this invention.

In the case of chemical etching, since ferrite is eluted by an acid, a passive film is formed at a flow velocity of zero as etching proceeds. Accordingly, a desired steep-sided deep groove shape cannot be obtained. However, an increase of flow velocity to a significant extent prevents the formation of the passive film.

The etching effect when the etchant flows along the lengthwise direction of the grooves is about the same as that when the etchant flows in a direction vertical to such lengthwise direction. When the liquid is caused to flow in the direction vertical to the lengthwise direction of the grooves, both side walls of the grooves are completely dissolved because convection occurs in the flow direction of the liquid.

The method of the present invention can be applied to steel sheets at any step of the production process after final cold rolling. For example, with a steel sheet subjected to final cold rolling or decarbonizing annealing, the sheet may be etched after a resist agent has been coated on the sheet. With a steel sheet subjected to finishing annealing, the sheet may be etched after the coated film on the sheet has been locally removed by a knife edge, a laser beam or the like.

As described above, either electrolytic etching and chemical etching can be used as the etching method. In electrolytic etching NaCl, KCl, $CaCl_2$, $NaNO_3$ or the like may be used as the electrolyte, for example. In chemical etching $FeCl_3$, $HNO_3$, Hcl, $H_2SO_4$ or the like may be used as the treatment liquid, for example.

In the case of chemical etching, at least one slit nozzle may be provided having a length greater than the width of the moving steel sheet. It may be directed to face the front or back surface of the moving steel sheet, or both, in the etching bath. The etchant flows to the slit nozzle from a pump through a pipe and is applied to the surface of the steel sheet from the nozzle.

In the case of electrolytic etching, at least one slit nozzle is provided, which may be of the same type as used in chemical etching, between the surface of the moving steel sheet and the electrodes in the electrolytic bath.

The flow direction of the etchant can be regulated by adjusting the angle of the slit nozzle with respect to the surface of the steel sheet and by adjusting the angle of the body of the slit nozzle with respect to the direction of movement of the steel sheet.

The flow velocity of the etchant can be adjusted by adjusting a valve provided in an intermediate position of the pipe.

The flow velocity of the etchant may be measured while it is flowing out of the slit nozzle, for example, by using a hot-wire current meter.

The following Examples are intended to be illustrative, and are not intended to define or to limit the scope of the invention, which is defined in the appended claims.

EXAMPLE 1

After final cold rolling, resist ink was coated as a masking agent on a steel sheet (thickness 0.23 mm) before finishing annealing so that uncoated portions remained with a width of 0.2 mm in the direction vertical to the rolling direction at intervals of 3 mm measured in the rolling direction. Linear grooves were thus formed in the direction vertical to the rolling direction.

The linear grooves were formed by using as an electrolytic bath an NaCl bath at a temperature of 40° C. for an electrolysis time of 20 seconds with an electrode distance of 30 mm and a current density of 10 A/dm$^2$. The electrolyte used was caused to flow at various relative flow velocities on a specimen in the direction vertical to the rolling direction of the steel sheet, i.e., the lengthwise direction of the grooves formed, while the specimen was moved in the rolling direction.

An attempt was also made to variously change the angle of the groove side wall and the shape of the irregularity at the groove bottom by changing the electrolytic etching conditions, with the same maximum depth $D_0$ and groove width.

In this example, the maximum depth of the grooves was about 20 $\mu$m, and the groove width was about 210 $\mu$m.

The steel sheet having the thus-formed linear grooves was subjected to decarburizing annealing and then finishing annealing in a laboratory. After an insulating film was formed on the steel sheet, the sheet was subjected to stress relief annealing at 800° C. for 3 hours.

Samples were also obtained from adjacent portions of a finally cold rolled coil of the same material as that of the above sample in which the grooves were formed. The samples were subjected to a series of the same processes as that for the above material without the formation of grooves in a laboratory, and were used as conventional samples.

The magnetic characteristics of the steel sheet samples were measured after stress relief annealing. The results of measurement are shown in Table 1.

Table 1 shows that the samples of the present invention have low iron loss $W_{17/50}$ and high flux density $B_8$, as compared with the comparative sample and conventional sample.

TABLE 1

| Sample No. | Section | Groove Sectional Form θ(°) | Groove Sectional Form $D_1/D_0$ | Relative Velocity of Liquid (m/s) | Iron Loss $W_{17/50}$ (W/kg) | Magentic Flux Density $B_8$(T) |
|---|---|---|---|---|---|---|
| 1 | Example of This Invention | 10 | ¾ | 1.00 | 0.78 | 1.90 |
| 2 | Example of This Invention | 15 | ⅞ | 1.20 | 0.78 | 1.90 |
| 3 | Example of This Invention | 40 | ¾ | 0.20 | 0.80 | 1.89 |
| 4 | Example of This Invention | 55 | ½ | 0.15 | 0.83 | 1.90 |
| 5 | Comparative Example | 70 | ⅓ | 0.03 | 0.85 | 1.89 |
| 6 | Conventional Example | Material Without Groove | | | 0.88 | 1.91 |

EXAMPLE 2

Resist ink was coated as a masking agent on a steel sheet (thickness of 0.20 mm) which was not subjected to finishing annealing after final cold rolling so that uncoated portions remained with a width of 0.2 mm in the direction vertical to the rolling direction at intervals of 3 mm in the rolling direction. Linear grooves were thus formed in the direction vertical to the rolling direction.

The grooves were formed on the thus-formed sample so that the sample had preferred magnetic characteristics. The magnetic characteristics were then examined.

Chemical etching was effected using a $FeCl_3$ bath as an etching bath at a temperature of 35° C. and a concentration of 50%.

The liquid was caused to flow at various relative flow velocities to the sample in the direction vertical to the rolling direction of the steel sheet, i.e., the lengthwise direction of the grooves formed, while the sample was moved in the rolling direction of the steel sheet.

The angle of the groove side wall and the shape of the irregularity at the groove bottom were variously changed by changing the etching conditions with the same maximum groove depth and groove width.

In this example, the maximum groove depth of the grooves was about 22 μm, and the groove width was about 180 μm.

The steel sheet having the linear grooves formed by the above method was subjected to decarburizing annealing and finishing annealing in the same way as in Example 1. The steel sheet was then subjected to flattening annealing and then stress relief annealing at 800° C. for 3 hours.

Steel sheet samples were also obtained from adjacent portions of a finally cold rolled coil of the same material as the above sheet having the grooves formed. The samples were subjected to a series of the same processes as that described above without formation of grooves, and were used as conventional samples.

The magnetic characteristics of the steel sheets samples were measured after stress relief annealing. The results of measurement are shown in Table 2.

Table 2 reveals that the samples of the present invention have low iron loss $W_{17/50}$ and high magnetic flux density $B_8$, as compared with the comparative sample and the conventional sample.

TABLE 2

| Sample No. | Section | Groove Sectional Form θ(°) | Groove Sectional Form $D_1/D_0$ | Relative Velocity of Liquid (m/s) | Iron Loss $W_{17/50}$ (W/kg) | Magentic Flux Density $B_8$(T) |
|---|---|---|---|---|---|---|
| 7 | Example of This Invention | 5 | 5/6 | 2.00 | 0.71 | 1.90 |
| 8 | Example of This Invention | 20 | ¾ | 0.50 | 0.72 | 1.89 |
| 9 | Example of This Invention | 25 | ⅔ | 0.40 | 0.74 | 1.90 |
| 10 | Example of This Invention | 35 | ⅔ | 0.20 | 0.74 | 1.90 |
| 11 | Comparative Example | 75 | ¼ | 0.05 | 0.80 | 1.89 |
| 12 | Conventional Example | Material Without Groove | | | 0.83 | 1.91 |

EXAMPLE 3

A steel sheet which was subjected to final cold rolling to a thickness of 0.20 mm was subjected to finishing annealing. After an insulating film was formed on the steel sheet, the insulating film was linearly removed by a knife edge so that the width in the direction vertical to the rolling direction was 0.2 mm, and the interval in the rolling direction was 3 mm to obtain a sample. Linear grooves were thus formed in the direction vertical to the rolling direction.

Like in Example 1, the linear grooves were formed by using a NaCl bath as an electrolytic bath at a temperature of 40° C. for an electrolysis time of 20 seconds with an electrode distance of 30 mm and a current density of 10 A/dm$^2$. The electrolyte was caused to flow at various relative flow velocities to the sample in the direction vertical to the rolling direction of the steel sheet, while the sample was moved in the rolling direction of the steel sheet.

During etching, the angle of the groove side wall and the shape of the irregularity at the groove bottom were variously changed by changing the electrolytic etching conditions with the same maximum groove depth $D_0$ and groove width. In this example, the maximum groove depth was about 24 μm, and the groove width was about 160 μm.

An insulating film was again formed on the steel sheet having the linear grooves formed by the above method, followed by stress relief annealing at 800° C. for 3 hours.

The magnetic characteristics of the steel sheets which were subjected to stress relief annealing were measured. The results of measurement are shown in Table 3.

Table 3 reveals that the samples of the present invention have low iron loss $W_{17/50}$ and high magnetic flux density $B_8$, as compared with the comparative sample and the conventional sample.

TABLE 3

| Sample No. | Section | Groove Sectional Form θ(°) | Groove Sectional Form $D_1/D_0$ | Relative Velocity of Liquid (m/s) | Iron Loss $W_{17/50}$ (W/kg) | Magentic Flux Density $B_8$(T) |
|---|---|---|---|---|---|---|
| 13 | Example of This Invention | 5 | ¾ | 2.80 | 0.70 | 1.89 |
| 14 | Example of This Invention | 20 | ⅞ | 1.00 | 0.71 | 1.89 |
| 15 | Example of This Invention | 30 | ⅔ | 0.30 | 0.74 | 1.89 |
| 16 | Example of This Invention | 60 | 7/12 | 0.15 | 0.76 | 1.88 |
| 17 | Comparative Example | 70 | ¼ | 0.06 | 0.81 | 1.89 |
| 18 | Conventional Example | Material Without Groove | | | 0.82 | 1.90 |

EXAMPLE 4

A steel sheet which was subjected to final cold rolling to a thickness of 0.23 mm was subjected to finishing annealing. After an insulating film was formed on the steel sheet, the insulating film was linearly removed by a knife edge so that the width in the direction vertical to the rolling direction was 0.2 mm, and the interval in the rolling direction was 3 mm to obtain a sample. Linear grooves were thus formed in the direction vertical to the rolling direction.

As in Example 2 the linear grooves were formed by chemical etching using a $FeCl_3$ bath as an etching bath at a temperature of 35° C. and a concentration of 50%. The liquid was caused to flow at various relative flow velocities to the sample in the direction vertical to the rolling direction of the steel sheet, while the sample was moved in the rolling direction of the steel sheet.

During etching, the angle of the groove side wall and the shape of the irregularity at the groove bottom were variously changed by changing the electrolytic etching conditions with the same maximum groove depth $D_0$ and groove width. In this example, the maximum groove depth was about 18 μm, and the groove width was about 200 μm.

An insulating film was again formed on the steel sheet having the linear grooves formed by the above method, followed by stress relief annealing at 800° C. for 3 hours.

The magnetic characteristics of the steel sheets which were subjected to stress relief annealing were measured. The results of the measurements are shown in Table 4.

Table 4 reveals that the samples of the present invention have low iron loss $W_{17/50}$ and high magnetic flux density $B_8$, as compared with the comparative sample and the conventional sample.

TABLE 4

| Sample No. | Section | Groove Sectional Form θ(°) | Groove Sectional Form $D_1/D_0$ | Relative Velocity of Liquid (m/s) | Iron Loss $W_{17/50}$ (W/kg) | Magentic Flux Density $B_8$(T) |
|---|---|---|---|---|---|---|
| 19 | Example of This Invention | 5 | 5/7 | 2.50 | 0.76 | 1.90 |
| 20 | Example of This Invention | 10 | 4/7 | 0.90 | 0.81 | 1.89 |
| 21 | Example of This Invention | 40 | 5/6 | 0.15 | 0.80 | 1.90 |
| 22 | Example of This Invention | 45 | ½ | 0.15 | 0.83 | 1.89 |
| 23 | Comparative Example | 75 | ⅓ | 0.02 | 0.85 | 1.90 |
| 24 | Conventional Example | Material Without Groove | | | 0.88 | 1.91 |

The present invention thus has the remarkable effect of stably reducing the iron loss of a grain oriented electromagnetic steel sheet by at least 0.05 W/kg even after stress relief annealing without deteriorating the magnetic characteristics, as compared with a conventional grain oriented electromagnetic steel sheet having no linear groove. The present invention is also capable of forming stable linear grooves having the remarkable effect of reducing the iron loss of the steel sheet.

Although this invention has been described with reference to specific chemical and electrolytic etching processes, it is not intended to be limited to the chemical agents or conditions selected for illustration in the specification. Various equivalent chemical and electrolytic agents and grooving directions may be utilized. Further, the steep side walls of the deep grooves need not be strictly linear or at a right angle to the thickness direction of the sheet, since grooves with more gradually angled side walls as indicated in FIG. 1 of the drawings provide excellent results, as described in the specification and Examples. Moreover, the protrusions located in the neighborhood of the groove bottom may be of various sizes and shapes but should not extend upwardly from the groove bottom more than about half of the total groove depth, all as illustrated herein and described, within the spirit and scope of the appended claims.

What is claimed is:

1. A low-iron loss final finish annealed grain oriented electromagnetic steel sheet having a plurality of linear grooves formed on the surface, said grooves formed with a maximum depth of about 100 μm or less, and extending in the direction substantially perpendicular to the rolling direction of said sheet so as to improve the magnetic characteristics of the steel sheet, wherein said linear grooves have side walls in which the angle of a groove side wall to the thickness direction of the sheet is about 60° or less, and wherein bottom portions of said grooves have projections and wherein the depth at the top of a projection is at least about $\frac{1}{2}$ of the total groove depth.

* * * * *